US005595428A

United States Patent [19]

Huang

[11] Patent Number: 5,595,428

[45] Date of Patent: Jan. 21, 1997

[54] ERGONOMIC KEYBOARD DRAWER

[76] Inventor: Michael Huang, 8527 Beverly Dr., San Gabriel, Calif. 91706

[21] Appl. No.: 508,748

[22] Filed: Jul. 28, 1995

[51] Int. Cl.[6] ..... A47B 81/00; A47B 97/00

[52] U.S. Cl. ..... 312/223.3; 312/208.1; 312/196; 312/223.6; 108/25; 108/26; 108/143; 248/918

[58] Field of Search ..... 312/208.1, 196, 312/322, 323, 223.3, 223.6; 108/143, 25, 26, 50; 248/918

[56] References Cited

U.S. PATENT DOCUMENTS

| | | | |
|---|---|---|---|
| 4,688,862 | 8/1987 | Fowler et al. | 312/223.3 X |
| 4,709,972 | 12/1987 | La Budde et al. | 312/223.3 X |
| 4,736,689 | 4/1988 | Stanko | 312/323 X |
| 4,931,978 | 6/1990 | Drake et al. | 108/143 X |
| 4,980,676 | 12/1990 | Nomura et al. | 248/918 X |
| 5,056,743 | 10/1991 | Zwar et al. | 248/918 X |
| 5,071,204 | 12/1991 | Price et al. | 312/223.3 X |
| 5,213,401 | 5/1993 | Hatcher | 312/208.1 |
| 5,287,815 | 2/1994 | Gross | 312/208.1 X |
| 5,294,087 | 3/1994 | Drabczyk et al. | 108/143 X |
| 5,337,985 | 8/1994 | Hale | 248/918 X |
| 5,351,897 | 10/1994 | Martin | 248/918 X |

FOREIGN PATENT DOCUMENTS 663881 1/1988 Germany .

*Primary Examiner*—Peter M. Cuomo
*Assistant Examiner*—Rodney B. White
*Attorney, Agent, or Firm*—Robert A. Schruhl; Terrell P. Lewis

[57] ABSTRACT

A computer keyboard drawer which exhibits advanced design features that maximize keyboard user's access and comfort and is capable of accepting for support non-conventional ergonomically designed keyboards is disclosed.

6 Claims, 4 Drawing Sheets

FIG. 2
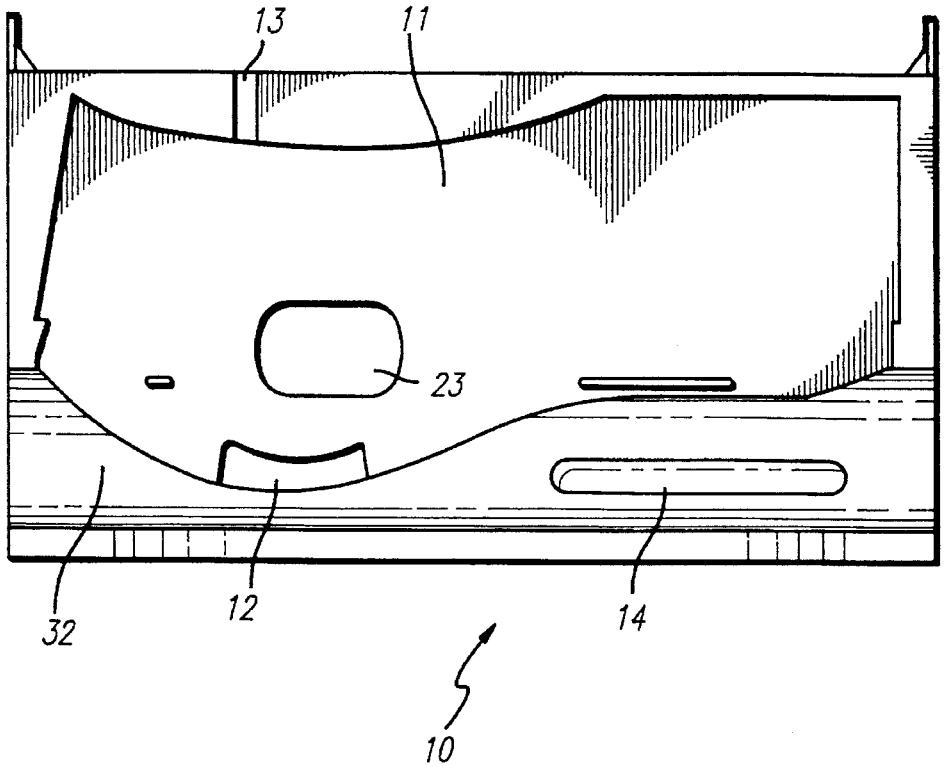
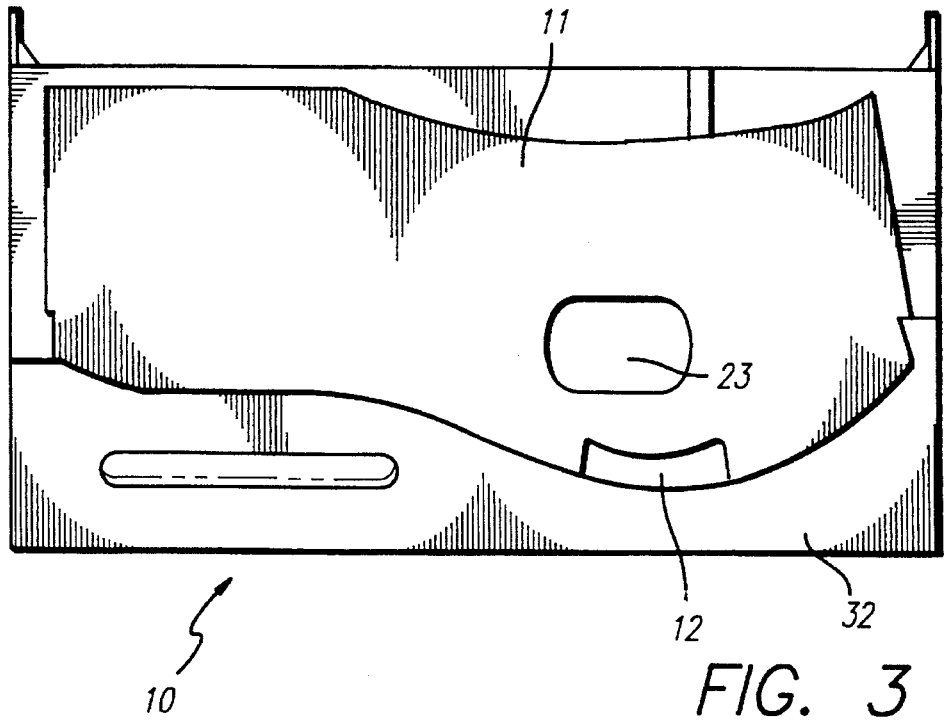
FIG. 3

ERGONOMIC KEYBOARD DRAWER

BACKGROUND OF THE INVENTION

1. Field of the Invention

The present invention relates generally to office furniture and the like, in particular, to a keyboard drawer for supporting an ergonomically designed keyboard, said keyboard being characterized as having a wider and higher profile than conventional keyboards so as to provide for greater ease of access and use by the operator.

2. Description of the Related Art

Keyboard drawers are well known in the art and typically comprise a drawer which is mounted upon left and right slide assemblies secured to the bottom surface of a desk top or the like. It is also well known to provide shelves for keyboards which may be mounted either forward of the desk top surface or within a front cutout of the desk, as shown in U.S. Pat. No. 4,515,086.

While many designs for keyboard drawers are known in the art, for example U.S. Pat. Nos. 4,496,200 and 4,483,572 disclose drawers for transporting a keyboard component, they do not address the long felt need of this market for a drawer that will support and/or transport a keyboard built with ergonomic based designs and features. The Microsoft Corporation manufactures an ergonomically designed keyboard, "Natural Keyboard", that provides greater ease of access and operational comfort for the operator by providing a wider and more elevated key function area and wrist rest area. The well chronicled health related problems associated with extended computer use are finally being addressed by advanced designed computer components and accessories, such as the ergonomically designed "Natural Keyboard".

Conventionally designed and manufactured keyboard drawers and shelves are not designed to accept the larger and more advanced keyboards of ergonomic design, in particular, conventionally designed keyboard drawers have limited key function areas and are therefore limited in their ability to address the acknowledged need for increased wrist rest areas associated with key function areas. Hand fatigue leading to such common maladies as Carpusal Syndrome are becoming more prevailment among computer users. The advanced ergonomically designed in features of the present invention address this problem of computer operator fatigue in such a manner unknown in the existing art.

SUMMARY OF THE INVENTION

Accordingly, it is an objective of the invention to provide an inexpensive, sturdy keyboard drawer that encompasses advanced ergonomic design features.

It is a further object of the invention to provide a keyboard drawer that will allow the computer user to make needed adjustments to a keyboard without the need to physically pick the keyboard up from the support it is resting on. This ability to make adjustments when needed to a keyboard, without having to physically pick the keyboard up, materially adds to the ease of use and operation of the keyboard which in turn results in a reduction of stress experienced by computer operators.

It is yet another object of the invention to provide a keyboard drawer that not only provides a support function for a keyboard but also directly affects the overall working environment by increasing the available wrist rest area for the computer operator's hands. By providing for an extended area upon which the operator may comfortably rest his/her wrists, the physical fatigue and stress that builds up in the fingers and hands of the operators can be substantially reduced.

It is another object of the invention to provide a means whereby the keyboard operator can easily access the adjustment means of the keyboard, without having to physically pick the keyboard up, and at the same time be able to position and lock the adjustment means in a desired position.

It is another object of the invention to provide an alternative embodiment of the invention that will allow for the mounting of the invention above a desk top or other support surface and at the same time provide sufficient structural support for additional computer components mounted thereon.

It is yet another object of the invention to provide a computer keyboard drawer that encompasses advanced ergonomic design and aesthetic features that will allow the drawer to accept an ergonomically designed keyboard in such a manner that the combination drawer and keyboard has the appearance of one continuous unit.

These and other objects of the invention are achieved by the provision of an ergonomically designed keyboard drawer having a shelf for supporting a keyboard that is generally flat and rectangular in configuration. The shelf is further characterized as having a recessed central surface that is tapered so that the forward edge of this recessed area is lower than the rear edge. The forward edge of the shelf that is continuous with the key function area of the keyboard, when the keyboard is mounted on the shelf, has an extended smoothed casing that functions to substantially increase the wrist rest area of the keyboard.

The recessed surface of the shelf has two holes or ports, one of which is directly aligned with the lift-up bar assembly of the keyboard so that the keyboard user can access this assembly to adjust the height or elevation of the keyboard. The second opening or port is located near the first port and provides the keyboard operator with access to the keyboard for manual elevation purposes. In a preferred embodiment, both openings or ports are located closely together so that the keyboard operator may manually push up or elevate the keyboard utilizing one port and while he has the keyboard manually elevated he can access the lift-up bar assembly of the keyboard for positioning purposes. Additionally a plurality of raised surface projections are associated with the recessed surface and are aligned along the lift-up bar assembly positioning arch. The shelf has a slot that provides a passage for a cable attached to the keyboard when said keyboard is mounted on the shelf. In a preferred embodiment, this slot is located at such a position on the shelf that the cable can be positioned within this slot without disturbing the close fit orientation of the keyboard on the shelf and at the same time avoid the unsightly bulky appearance often associated with keyboard and/or computer cables. A pullout slot is provided on the shelf so that the shelf may be manually positioned in relation to a desk or other support surface. In a preferred embodiment, this slot is located along the forward edge of the shelf and is of sufficient width so that a keyboard operator may easily grasp the drawer by this slot and position it as desired.

In any of its embodiments, the invention provides a sturdy keyboard drawer capable of accepting for support an advanced designed keyboard. The keyboard drawer contains no moving parts and can be reliably and inexpensively manufactured.

BRIEF DESCRIPTION OF THE DRAWINGS

The objects and features of the present invention, which are believed to be novel, are set forth with particularity in the appended claims. The present invention, both as to the organization and manner of operation, together with further objects and advantages, may best be understood by reference to the following description, taken in connection with the accompanying drawings.

FIG. 2 is a top perspective view of the keyboard drawer of the invention, shown also is the recessed central surface of said drawer with access ports and pullout slot.

FIG. 3 is a perspective view of the invention showing the underside of the drawer, access ports and raised surface projections located on the recessed surface.

FIG. 5 is a top perspective view of an alternative embodiment of the invention having a flat central surface and a tapered smoothed casing running along the forward edge of the invention.

DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide an advanced designed keyboard drawer that encompasses many long sought after ergonomic features that make computer keyboard operation more "natural" and less stressful.

Referring to the figures, various embodiments of the invention will be described.

Figure 1:
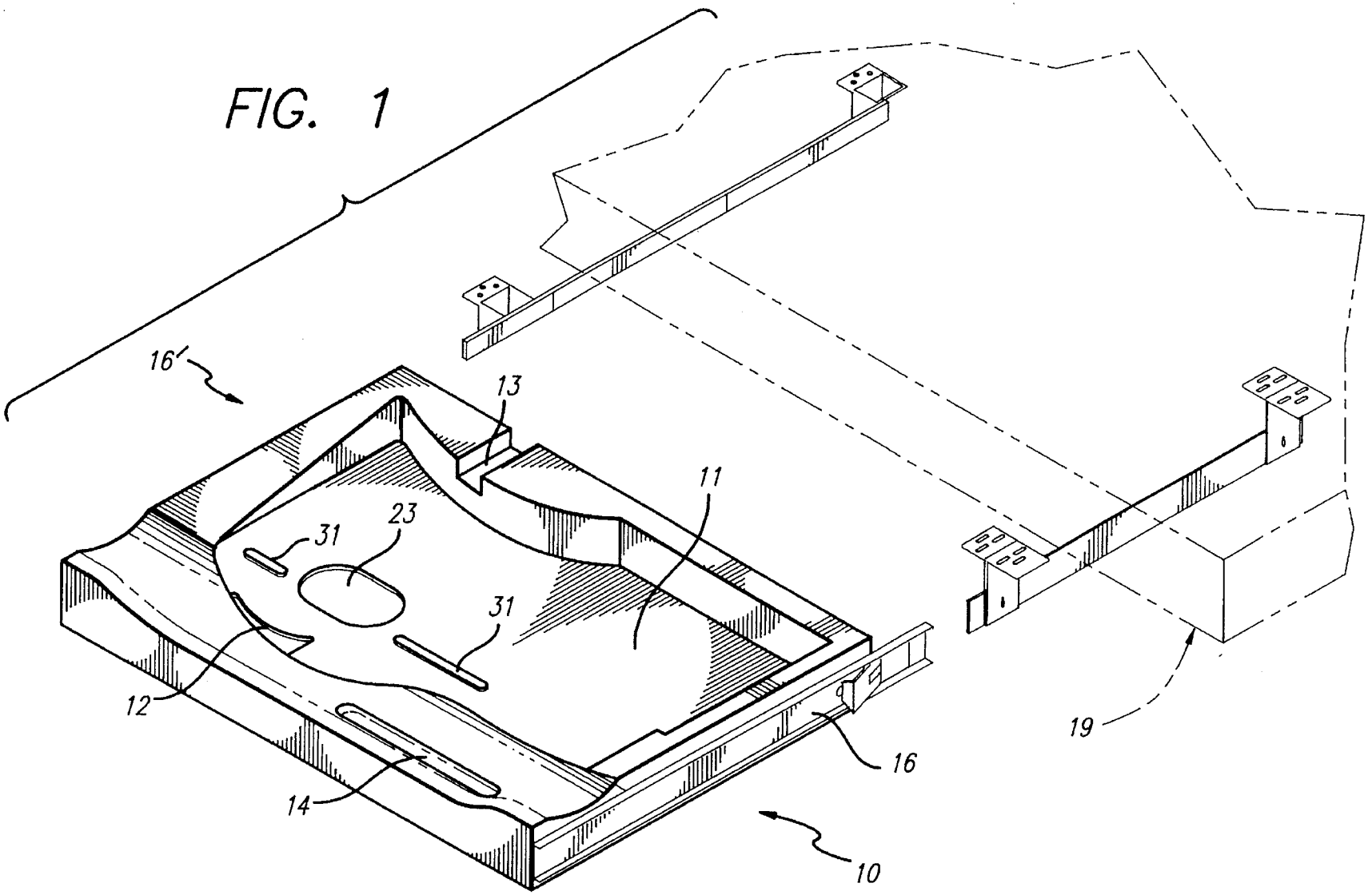
FIG. 1 is a top perspective view of an under desk mounted embodiment of the invention.
Figure 5:
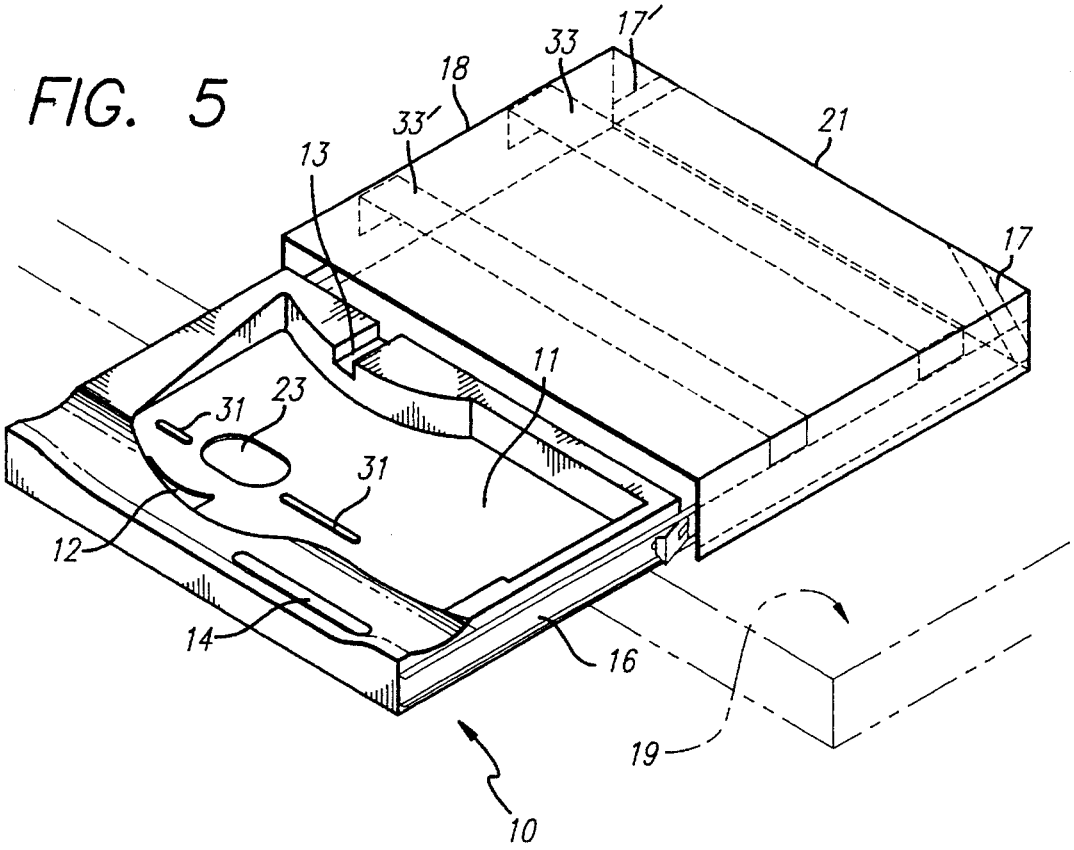
FIG. 5 is a perspective view of an alternative embodiment of the invention where the drawer is mounted above a desk or other support surface, shown are the corner support rods and surface supports built into the embodiment to provide support for computer components that may be mounted thereon.

In FIG. 1, an under desk mounted embodiment of an ergonomically designed keyboard shelf 10 is shown. Keyboard shelf 10 includes recessed surface area 11 with first and second ports 12 and 23 located on recessed surface 11. Also shown is pullout slot 14 and cable passage slot 13, both located on keyboard shelf 10. Keyboard shelf 10 is shown in one embodiment capable of being mounted below a desk top or other support surface 19 by mounting brackets 16 and 16'. Shelf 10 may be mounted to a desk or other support surface by one of a number of well known attachment means, including slide assemblies and mounting brackets of all designs. In an alternative embodiment keyboard shelf 10 may be mounted above a desk top or other support surface 19 as shown in FIG. 5, wherein corner support rods 17 and 17' and surface supports 33 and 33' provide structural support for housing 18 that can be mounted above a desk top or other surface 19, wherein keyboard shelf 10 is mounted to housing 18 by mounting brackets of the kind shown in FIG. 1 (16 and 16') or any other acceptable attachment and transport means. Computer components may be placed on load bearing surface 21 of housing 18. In a preferred embodiment corner support rods 17 and 17' and surface supports 33 and 33' are manufactured from steel 1 mm in thickness. Housing 18 with corner support rods 17 and 17' and surface supports 33 and 33', in a preferred embodiment, is capable of supporting up to 250 pounds of computer equipment placed thereon.

Access openings or ports 12 and 23 are shown in FIG. 2. In a preferred embodiment, access port 12 and access port 23 are located closely together and extend completely through shelf 10 at recessed surface 11. Access port 23 is located on recessed surface 11 at such a position that it is aligned with lift-up bar assembly 30 located on the underside of keyboard 25 so as to provide the keyboard operator with the ability to access and position lift-up bar assembly 30 when the keyboard operator is manually pushing up or elevating keyboard 25 via access port 12 on recessed surface 11. By utilizing both access ports, 12 and 23, the keyboard operator is able to make height adjustments in the keyboard 25 without the need to physically remove keyboard 25 from shelf 10. In a preferred embodiment, Pullout slot 14 as shown in FIGS. 1 and 2, is located along the forward edge of shelf 10 so as to be readily accessible to a keyboard operator for manually positioning shelf 10 in relation to desk top or other support surface 19.

Figure 4:
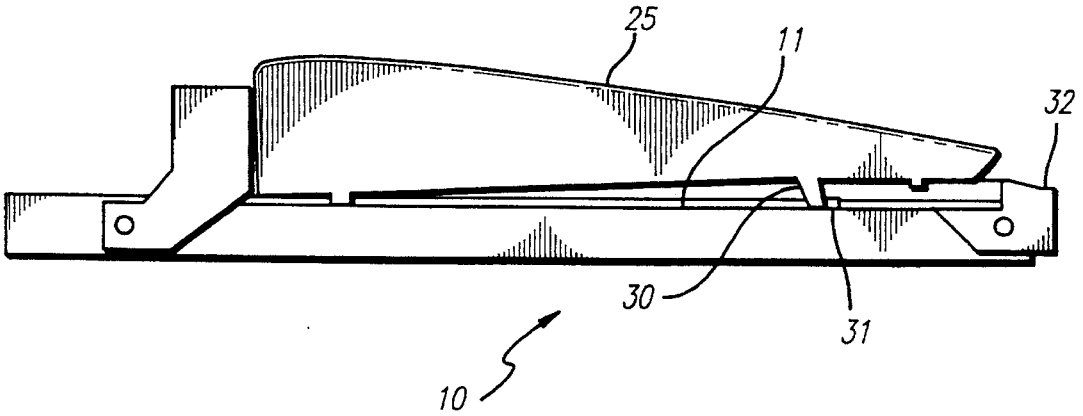
FIG. 4 is a side perspective view of the drawer of the invention and a keyboard supported thereon, the keyboard being elevated within the recessed surface of the drawer by the lift-up bar assembly of the keyboard, the lift-up bar assembly being secured in a desired position by the raised surface projections on the recessed surface of the drawer.

Raised surface projections 31 are shown in FIGS. 1, 4, 5 and 6. FIG. 4 is a side perspective view of a keyboard 25 being elevated within raised surface 11 of shelf 10 by lift-up bar assembly 30. Projections 31 are shown in FIG. 4 securing lift-up bar assembly 30 by impeding any movement of bar 30 once it has been lowered or placed in a desired position. Projections 31 may be in the form of "molded bumps" or other extra surface impediments or they may take the form of slots, openings or cavities capable of accepting and holding the base of lift-up bar assembly 30. The most important criteria for projections 31 are that they be permanently attached to recessed surface 11, that they be able to impede any possible movement of bar 30 and that they must be aligned along the "positioning arch" of bar 30. Bar 30 of keyboard 25 may be positioned as desired and projections 31 must be so aligned as to interact with bar 30 to prevent bar 30 from slipping or moving after being positioned.

Wrist rest area 32 on shelf 10 is shown on FIGS. 2 and 3. Conventional keyboards utilize standard typewriter size keypads or key function areas. In ergonomically designed keyboards one of the primary purposes is to maximize access and minimize stress that builds up during prolonged periods of keyboard or computer operation. In response to this long felt need corporations such as Microsoft have begun to market keyboards, such as Microsoft's "Natural Keyboard", with enlarged keypads or key function areas including wrist rest areas. Wrist rest areas are limited, if not absent altogether, in most commercially available keyboards. The present invention includes an extended wrist rest area that works in conjunction with the wrist rest areas of ergonomic keyboards such as "Natural Keyboard". Wrist rest area 32 comprises an extended smoothed casing area along the forward edge of shelf 10, said area being continuous with the key function or keypad area of commercially available keyboards, especially the wider than conventional ergonomically designed keyboards. In this regard the recessed surface of the invention is capable of accepting ergonomically designed keyboards that measure up to 21.3 inches in length and 2.5 inches in height. Therefore, it is one of the objectives of this invention to provide a keyboard drawer or shelf that can accommodate the larger non-conventional ergonomically designed keyboards.

Figure 6:
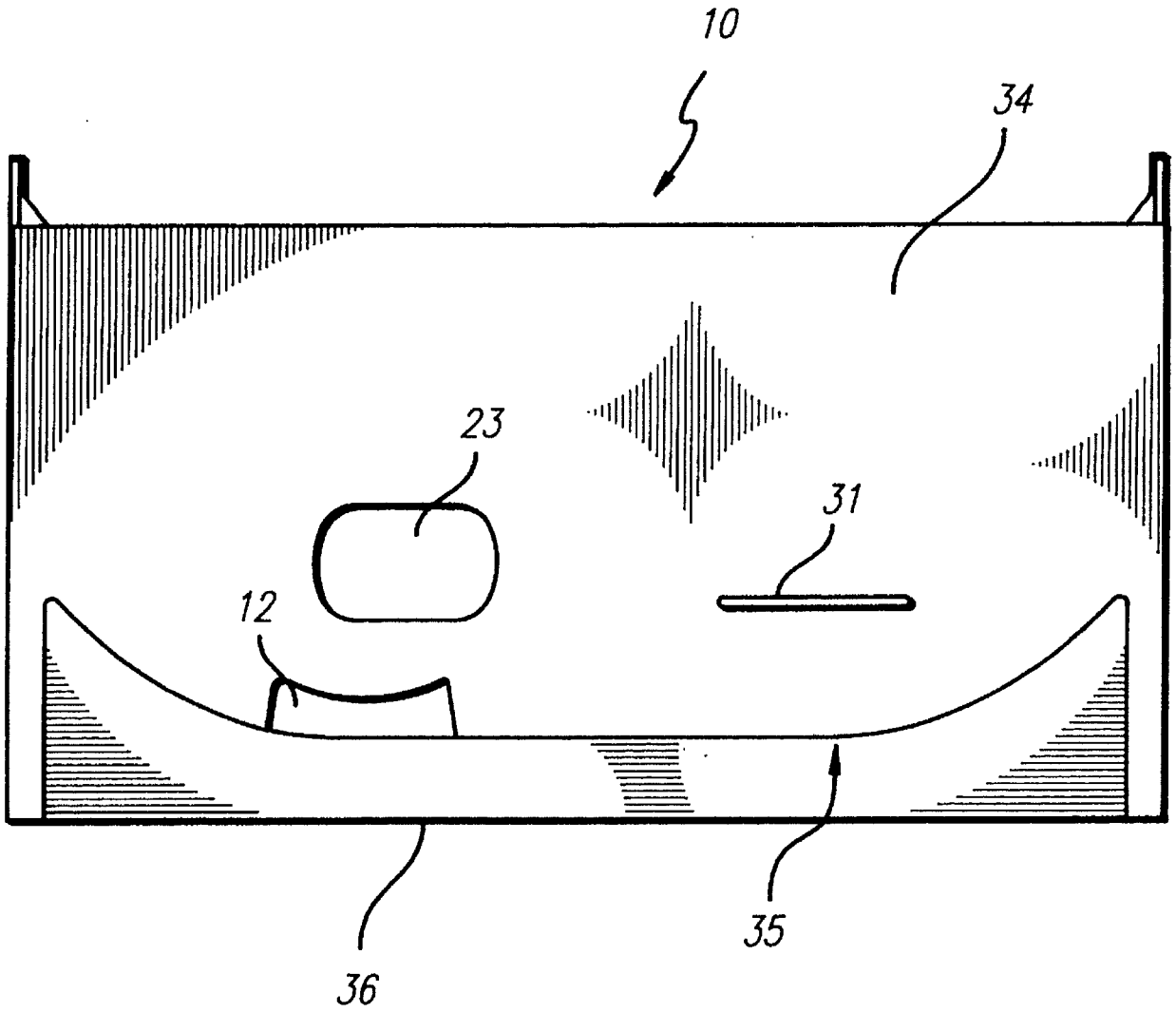

FIG. 6 shows an alternative embodiment of the invention wherein shelf 10 is shown having a flat central surface 34 and a smoothed tapered casing 35 extending along the from edge of shelf 10 resulting in an extended wrist rest area 36. Also shown are projections 31 positioned on said flat central surface 34 along the positioning arch of lift-up bar assembly 30 on keyboard 25.

Those skilled in the art will appreciate that various adoptions and modifications of the just-described preferred embodiments can be configured without departing from the scope and spirit of the invention. Therefore, it is to be understood that, within the scope of the appended claims, the invention may be practiced other than as specifically described herein.

What is claimed:

1. A support drawer apparatus for an ergonomic computer keyboard including a shelf for supporting the keyboard, and including means for attaching said shelf to a desk or support surface, said keyboard being of the type having means for elevating a portion of the keyboard when supported on the shelf, comprising:

a recessed central surface in said shelf capable of accepting for support an ergonomically designed keyboard, the keyboard having a non-rectangular bottom surface for supporting the keyboard on the recessed surface, the recessed surface being complementary in shape to the non-rectangular bottom surface of the keyboard, a first access port for temporarily manually elevating the ergonomically designed keyboard while supported within said recessed surface, a second access port for accessing a lift-up bar assembly of the ergonomically designed keyboard while supported within said recessed surface, said elevation means and said access means being located within a close proximity of each other, and raised projections for securing a lift-up bar assembly of the ergonomically designed keyboard in a desired elevational position while the ergonomically designed keyboard is supported within said recessed surface of said shelf.

2. The support drawer apparatus as set forth in claim 1, wherein said recessed surface is capable of accepting ergonomically designed keyboards having elevated and enlarged key function areas for greater access by an operator for reducing operator hand and fingers strain during periods of prolonged keyboard use.

3. The support drawer apparatus as set forth in claim 1, wherein said shelf is generally flat and rectangular in configuration having a forward and rear edge and a tapered wrist rest area extending along the forward edge of said shelf so as to extend a wrist area of an ergonomic keyboard supported within said recessed area of said shelf to provide for greater keyboard operator comfort and reduced stress in an operator's fingers and hands.

4. The support drawer apparatus of claim 1, wherein said shelf may be mounted above or below a support surface.

5. The support drawer apparatus of claim 4, and further including a reinforced housing for slidably mounting said shelf above a support surface, said housing capable of supporting computer components and other items placed on top of said housing.

6. The support drawer as set forth in claim 1, wherein said first and second access ports are arranged in said shelf central recessed surface proximal with the lift-up bar assembly of the ergonomic keyboard when the latter is supported within said recessed surface of said shelf.

* * * * *